US006357949B1

(12) United States Patent
Schwartzman

(10) Patent No.: US 6,357,949 B1
(45) Date of Patent: Mar. 19, 2002

(54) ARTICLE CONTAINING AN INTEGRAL LIQUID-RELEASE VALVE AND METHOD FOR MANUFACTURING A PRESSURE RESPONSIVE VALVE FOR FLUID DISPENSING CONTAINERS

(76) Inventor: Gil Schwartzman, 1025 Old White Plains Rd., Mamaroneck, NY (US) 10543

( * ) Notice: Subject to any disclaimer, the term of this patent is extended or adjusted under 35 U.S.C. 154(b) by 0 days.

(21) Appl. No.: 09/685,881

(22) Filed: Oct. 10, 2000

Related U.S. Application Data

(60) Provisional application No. 60/158,717, filed on Oct. 8, 1999.

(51) Int. Cl.[7] ..... B43M 11/06
(52) U.S. Cl. ..... 401/264; 401/206
(58) Field of Search ..... 401/186, 206, 401/264, 273

(56) References Cited

U.S. PATENT DOCUMENTS 3,410,645 A * 11/1968 Schwartzman ..... 401/206
4,693,623 A * 9/1987 Schwartzman ..... 401/206

* cited by examiner

*Primary Examiner*—Gregory L. Huson
*Assistant Examiner*—Peter deVoie
(74) *Attorney, Agent, or Firm*—Cohen, Pontani, Lieberman & Pavane

(57) ABSTRACT

An integrated pressure-responsive liquid-release valve has a first layer formed of a resiliently-deformable non-porous material and a second layer bonded to the first layer and formed of a deformable, preferably resiliently-deformable, porous material. A plurality of normally-closed slits are defined in and through the first layer of non-porous material. The slits are configured so that the application of material-deforming pressure to the first layer causes the slits to operatively open for passing liquid through the open slits, and the cessation of the applied material-deforming pressure causes the slits to close under the resilient return urgency of the non-porous material. The porous material receives liquid passed through the slits of the non-porous material first layer when material-deforming pressure is applied to the a non-porous material to open the slits. The slits may be arcuately configured such that each slit has a base which is intersected by at least one other slit, and such that each slit is out of intersecting relation with its own base. The integrated valve structure may be formed by spraying the non-porous material, in liquid form, onto a surface of the porous material, or by affixing the first and second material layers to each other by an interposed adhesive or laminate, and defining the slits in the non-porous material either before or after bonding of the layers to each other.

14 Claims, 2 Drawing Sheets

ARTICLE CONTAINING AN INTEGRAL LIQUID-RELEASE VALVE AND METHOD FOR MANUFACTURING A PRESSURE RESPONSIVE VALVE FOR FLUID DISPENSING CONTAINERS

This Application claim benefit to provisional Application No. 60/158,717 Oct. 8, 1999.

BACKGROUND OF THE INVENTION

1. Field of the Invention

The present invention relates broadly to pressure-responsive valves for fluid dispensing containers, and is more particularly directed to a method for manufacturing a pressure-responsive valve having high restoration forces and to an article containing such an integral liquid-release valve.

2. Description of the Related Art

Many fluid materials, especially liquids and pastes, and especially those useful in the fields of personal hygiene, cosmetics and toiletries, employ materials that deteriorate during extended storage. Thus, for example, many perfumes, colognes, aftershaves and the like contain alcohol as an important constituent. The evaporation of the alcohol over a long period of time deteriorates the material. Almost everyone has experienced the difficulty or futility of trying to remove toothpaste from a tube that has been left open; oftentimes one encounters a blockage of dried out toothpaste which prevents further use of the tube without gouging the dried material out of the neck. Similar problems arise in the storage of lotions, creams and the like. Likewise, many industrial materials which employ volatile solvents and may encounter similar problems.

FIGS. 1 and 2 show an embodiment of the pressure responsive valve disclosed in U.S. Pat. Nos. 4,620,648 and 4,693,623, both of which are incorporated herein by reference. Referring to FIG. 1, the basic concept of this pressure sensitive valve of the prior art is disclosed. The valve 10 comprises a diaphragm 12 of elastically deformable material. For most applications, diaphragm 12 can be made of metal or plastic, of elastically deformable metal such as certain steels useful for particular applications, or of a variety of elastically deformable plastic materials. Among the plastics which appear to have important utility in the present invention are polyethylene, polypropylene, polyvinylchloride and polystyrene.

The diaphragm is provided with two or more arcuate slits, here shown as three in number identified by the reference numerals 14*a*, 14*b* and 14*c*. Each of the slits 14*a*–14*c* are shown to be circular, that is of a fixed radius, although other curve or curvilinear forms may be employed in defining the arcuate slits 14. Thus, for example, the slits may be portions of spirals or helixes or a part of a sine curve or an Archimedes spiral.

Extending between the two ends of each arcuate slit 14*a*, 14*b* and 14*c* is an imaginary line, hereinafter referred to as the "base" of the slit. The bases are designated with the reference characters 15*a*, 15*b* and 15*c*. In the embodiment of the prior art valve shown in FIG. 1, at least one of the arcuate slits must intersect the base of another of the slits and should not curve around to intersect its own base. The slits are preferably equiangularly distributed on diaphragm 12.

The diaphragm 12 is located over or in an opening in a container such as a deformable (squeeze) bottle, or tube or the like in which is stored or disposed a supply of flowable material such as a liquid or a paste, although in certain instances gases might be so stored, to normally prevent fluid flow out of the container. The valve is normally closed, i.e. the diaphragm is undeformed with the slits closed. The valve may be operated to assume its open position by pressurizing the contents of the container against the inner surface of the diaphragm to apply a pressure differential across the diaphragm such that an outwardly directed force causes the valve to flex outwardly and open it along the slits 14*a*, 14*b* and 14*c*. The flexing of diaphragm 12 causes a rotation of the center with respect to the outer periphery as it moves outward in response to the force resulting from the applied pressure differential. Accordingly, upon relaxation or release of the inner pressure, the restorative force of the resilient material of the diaphragm will be sufficient to cause the deflected portion of the diaphragm to rotate in the opposite direction from the rotated direction experienced upon opening of the valve, and thereby cause and permit the deformed diaphragm portion to move back into the plane of the diaphragm and close the valve.

FIG. 2 shows the basic valve 10 of FIG. 1 in a modified form 110 incorporated into the neck 120 of a bottle 122 as a combined valve and applicator. The valve 110 and applicator 124 includes a diaphragm 112 of substantially identical configuration to the diaphragm 12 in FIG. 1, modified, however, so that the peripheral edge 16 of diaphragm 12 is integrally formed in the FIG. 2 embodiment with an upwardly extending peripheral wall portion 118 that is sealingly disposed, as by press-fit engagement, in the neck 120 of bottle 122. The press-fit engagement effectively seals and seats the diaphragm 112 such that an associated applicator pad 124 can be disposed as shown. Although not necessary, peripheral wall 118 may include an outwardly directed flange 119 to enhance the seal between the diaphragm 112 and bottle 122. The applicator pad 124 is typically formed of a material that is permeable to the fluid contained within the bottle, such as an open cell foam material or the like as is known. Such materials are themselves often elastically or resiliently deformable, permitting the resulting valved fluid dispenser to be employed as a dauber or dabber or other applicator by which the stored fluid is applied to a workpiece or surface by pressing the pod against the surface.

BRIEF DESCRIPTION OF THE DRAWINGS

In the drawings, wherein like reference characters denote similar elements throughout the several views.

DETAILED DESCRIPTION OF THE CURRENTLY PREFERRED EMBODIMENTS

In accordance with the present invention, a non-porous material, such for example as urethane, neoprene or a latex material, is nonreleasably adhered or bonded directly to one face of a piece—such as a slab or block—of porous material, such for example a closed cell foam. The porous material may by way of illustrative example take the form of a rectangular sponge or any other shape of material suitable for the particular intended application. The porous material is in any event preferably deformable, and most preferably elastically resilient, as will hereinafter be apparent. FIGS. 3–6 illustrate two processes for application of a non-porous material to one face or side of a porous foam.

Figure 3:
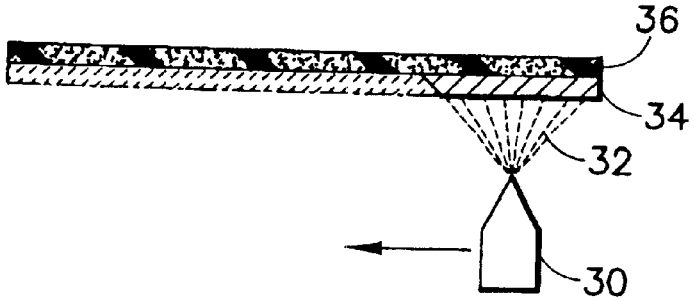
FIGS. 3 and 4 are cross-sectional side views depicting a process of forming a pressure-responsive liquid-release valve in accordance with a first embodiment of the inventive method.

Referring to FIG. 3, the non-porous material 34 (e.g. urethane) in initially liquid or flowable form is sprayed (at 32) from an applicator head 30 onto the underside or rear face of a porous foam 36 in a single or a series of sequentially applied layers. Spraying device 30 uniformly sprays the non-porous material 34 by simultaneously moving along the surface of foam 36 and spraying the material 34 onto the porous foam. Alternately, the non-porous material—in initially liquid or flowable form—may be rolled or painted onto the face of the porous foam. In either or any case, the non-porous material carries or is carried to form the non-porous layer 34. Such carrying may for example require the use of heat, or take place in the absence of heat by letting the material rest or set for a suitable period of time.

Figure 5:
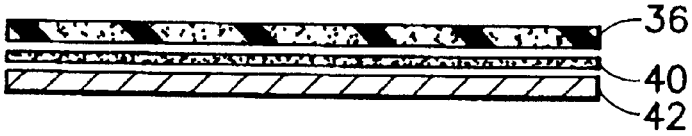
FIGS. 5 and 6 are cross-sectional side views depicting a process of forming a pressure-responsive liquid-release valve in accordance with a second embodiment of the I inventive method.
Figure 6:
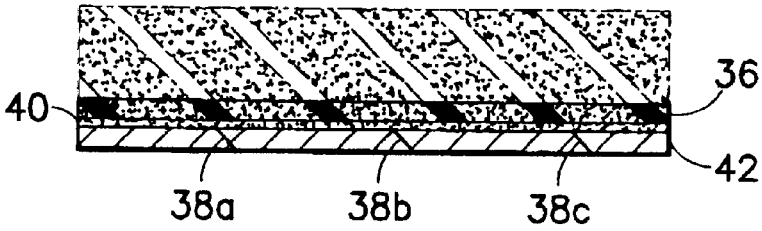

In other processes for forming the inventive valve, the non-porous material can be preformed and then laminated or otherwise affixed onto the surface of the porous foam material 36, as shown in FIGS. 5 and 6. Any suitable known lamination technique, such for example as, heat, glue, and flame lamination, may be used to adhere the non-porous material 42 to the porous material 36. By way of example, FIGS. 5 and 6 show an intermediate porous adhesive or laminate layer 40 used to effect the secure affixation of non-porous material 42 to porous material 36.

Figure 4:
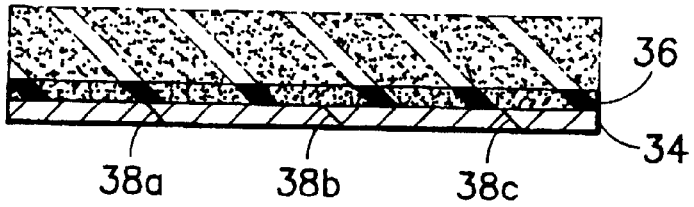

As shown in FIGS. 4 and 6, the porous foam like material can have any desired thickness as a function of, inter alia, the intended application. For example, for applying liquid soap to pots, pans and dishes and the like, it is preferable that the porous foam material be relatively thicker (as shown in phantom) so as to enable it to absorb more liquid for providing more even dispersion and application to the workpiece.

Figure 1:
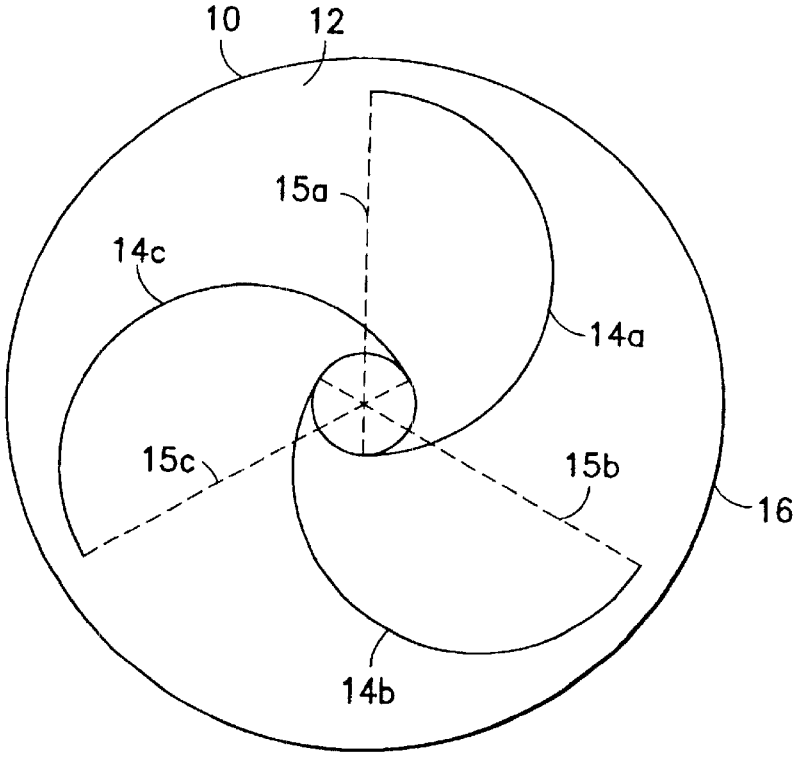
FIG. 1 (PRIOR ART)
FIG. 1 is a top plan view of a prior art pressure-responsive liquid-release valve.

Once the non-porous material is affixed to the porous material, a plurality of slits 38*a,* 38*b,* 38*c*—corresponding to and, preferably, configured in the same manner as the slits 14*a,* 14*b,* 14*c* of the valve of FIG. 1—are cut or otherwise defined in and through the non-porous material such that liquid or other fluid may be selectively dispensed—through the open slits 38*a,* 38*b,* 38*c* upon the application of deforming pressure to the non-porous material, as through the application of pressure to an associated liquid container in which the liquid is stored—into the porous material for the intended use. The particular number of slits, and their particular shapes, are substantially a matter of design choice but may, for example and as is preferred, be in accordance with the prior art valve of FIG. 1. One method for cutting slits 38*a,* 38*b,* 38*c* into the non-porous material so as to create a pressure responsive valve in the non-porous material is described in the aforementioned U.S. Pat. Nos. 4,620,648 and 4,693,623. The curvature of slits 38*a,* 38*b,* 38*c* should be sufficient—at least in conjunction with the flexibility characteristics of the porous material 36—to effect operative return flexibility to the resulting valve when pressure is removed from or not applied to the liquid container or otherwise to the non-porous material, thus enabling opening and closing movement of the non-porous material-defining valve in response to the respective application to and release of pressure from the non-porous material or the liquid container on which the valve is positioned. In accordance with one and generally preferred embodiment of the invention, the slits are cut only in and through the non-porous material, and do not extend into the porous material 36.

The porous foam material preferably has an inherent resilience that not only facilitates the resilient closure of the slits in the non-porous material upon release of the actuating pressure, but also provides sufficient integrity to assist in maintaining the slits in the non-porous material in the closed position when no pressure is applied to the liquid container.

In accordance with a further embodiment of the invention, the slits that are cut in the non-porous material to form the pressure responsive valve may also extend partially into (but preferably not fully through) the porous material 36. This extension of the slits into the porous material can facilitate the spreading and dispersal of the dispensed liquid material within the porous material, thus resulting in a more thoroughly and evenly dispensed liquid on the upper or application or working surface of the porous material.

It is also within the intended scope and contemplation of the invention that an integrated valve structure may be formed of a multiplicity of porous and/or non-porous materials layers. For example, a valve may illustratively be formed of four alternating layers of porous and non-porous material, with each of the non-porous layers having one or a plurality of liquid-release slits defined therein.

Figure 2:
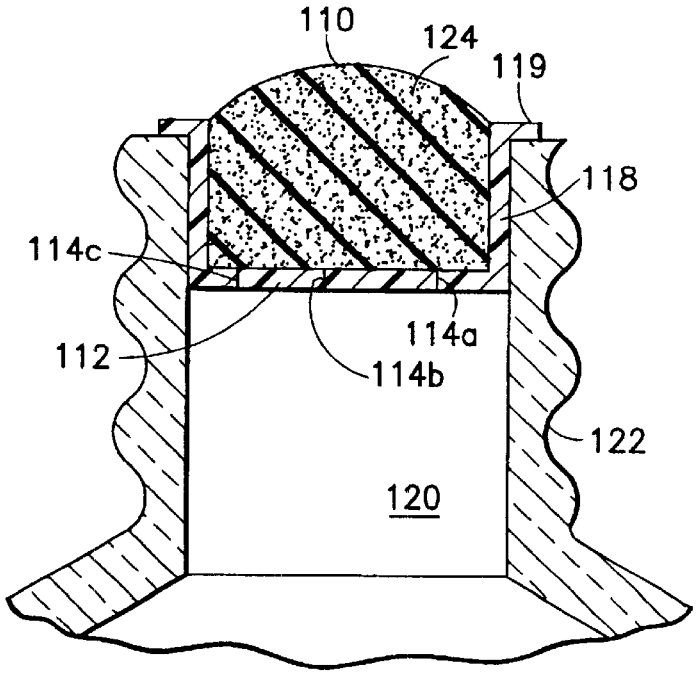
FIG. 2 (PRIOR ART)
FIG. 2 is a cross-sectional side view of a prior art liquid applicator utilizing a pressure-responsive liquid-release valve similar to that shown in FIG. 1.

As should be apparent, the integral valve structure provided in accordance with the present invention and formed of the unitary layered combination of a porous material and a non-porous material (or of multiple such layers) may be utilized in a variety of liquid or fluid applicator structures and devices, as for example that shown in prior art FIG. 2. Such applications and uses of the inventive valve structure are considered to be matters of design choice.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A pressure-responsive valve for selectively passing therethrough a fluid in response to pressure applied to the valve, comprising:

a first layer formed of a resiliently-deformable non-porous material and having a plurality of normally-closed slits defined in and through the non-porous material layer as valve openings through which fluid is operatively passable, said slits being configured so that an application of material-deforming pressure to the non-porous material causes the slits to operatively open for passing fluid through the open slits, and a cessation of the application of material-deforming pressure to the non-porous material causes the slits to close under a resilient return urgency of the non-porous material to prevent passage of fluid through the slits; and a second layer coextensively overlying and bonded to the non-porous material first layer throughout all of the coextensively overlying second layer to form with said first layer an integral fluid-release valve, said second layer being formed of a deformable porous material for receiving in the porous material second layer fluid passed through the slits of the non-porous material first layer when material-deforming pressure is applied to the non-porous material to open the slits.

2. A pressure-responsive valve in accordance with claim 1, wherein said second layer is formed of a resiliently-deformable porous material to provide, by a resilient return urgency of the porous material, assistive slit-closing restorative forces for closing said slits when the application of material deforming pressure to the non-porous material has ceased.

3. A pressure-responsive valve in accordance with claim 2, wherein said porous material comprises an open-cell foam.

4. A pressure-responsive valve in accordance with claim 2, wherein said non-porous material comprises urethane.

5. A pressure-responsive valve in accordance with claim 1, wherein said non-porous material comprises urethane.

6. A pressure-responsive valve in accordance with claim 1, wherein each of said slits has a base which is intersected by at least one other of said slits, and each of said slits is out of intersecting relation with its own base.

7. A method of making an integral fluid-release valve for selectively passing therethrough a fluid in response to pressure applied to the valve, comprising the steps of:

bonding, to a first layer formed of a deformable porous material, a second layer formed of a resiliently-deformable non-porous material and coextensively overlying said first layer, said second layer being bonded to said first layer throughout all of said coextensively overlying second layer for forming an integrated valve structure; and defining, in and through said second layer, a plurality of normally-closed slits through which fluid is operatively passable, the slits being configured so that an application of deforming pressure to the integrated valve structure causes the slits to operatively open for passing fluid through the open slits, and a cessation of the application of deforming pressure to the integrated valve structure causes the slits to close under a resilient return urgency of the non-porous material to prevent passage of fluid through the slits.

8. A method in accordance with claim 7, wherein said bonding step comprises applying the non-porous material in liquid form to a surface of the porous material, and curing the applied liquid-form non-porous material to provide the second layer bonded to the porous material first layer.

9. A method in accordance with claim 8, wherein said applying step comprises spraying the liquid-form non-porous material onto the surface of the porous material.

10. A method in accordance with claim 7, wherein said bonding step comprising affixing the second layer to the first layer by disposing an adhesive material between the first and second layers to bond the second layer to the first layer.

11. A method in accordance with claim 7, wherein said bonding step comprising affixing the second layer to the first layer by disposing a laminate layer between the first and second layers, and applying heat to the laminate layer to bond the second layer to the first layer.

12. A method in accordance with claim 7, wherein said slit-defining step comprises configuring the slits such that each of the slits has a base which is intersected by at least one other of the slits, and such that each of the slits is out of intersecting relation with its own base.

13. A method of making an integral fluid-release valve for selectively passing therethrough a fluid in response to pressure applied to the valve comprising the steps of:

bonding, to a first layer formed of a deformable porous material, a second layer formed of a resiliently-deformable non-porous material for forming an integrated valve structure, wherein said bonding step comprises applying the non-porous material in liquid form to a surface of the porous material, and curing the applied liquid-form non-porous material to provide the second layer bonded to the porous material first layer; and defining, in and through said second layer, a plurality of normally-closed slits through which fluid is operatively passable, the slits being configured so that an application of deforming pressure to the integrated valve structure causes the slits to operatively open for passing fluid through the open slits, and a cessation of the application of deforming pressure to the integrated valve structure causes the slits to close under a resilient return urgency of the non-porous material to prevent passage of fluid through the slits.

14. A method in accordance with claim 13, wherein said applying step comprises spraying the liquid-form non-porous material onto the surface of the porous material.

* * * * *